United States Patent [19]

Teel

[11] Patent Number: 4,972,389

[45] Date of Patent: Nov. 20, 1990

[54] ELECTROACOUSTIC TRANSDUCER

[75] Inventor: Willis A. Teel, Panama City, Fla.

[73] Assignee: The United States of America as represented by the Secretary of the Navy, Washington, D.C.

[21] Appl. No.: 322,805

[22] Filed: Jan. 2, 1973

[51] Int. Cl.[5] ..... H04R 17/00

[52] U.S. Cl. ..... 367/155; 310/337; 367/157; 367/166

[58] Field of Search ..... 340/8, 9, 10, 12, 13, 340/7, 17; 310/9.6, 320, 337; 367/166, 155, 157

[56] References Cited

U.S. PATENT DOCUMENTS

| | | | |
|---|---|---|---|
| 2,161,980 | 6/1939 | Runge et al. | 310/9.6 X |
| 2,405,605 | 8/1946 | Goodale, Jr. et al. | 340/9 UX |
| 2,855,572 | 10/1958 | Gitzendanner | 340/10 X |
| 2,877,432 | 3/1959 | Mattiat | 340/10 AX |
| 3,015,789 | 1/1962 | Honda et al. | 310/9.6 X |
| 3,111,595 | 11/1963 | Junger | 340/10 X |
| 3,158,762 | 11/1964 | Horan | 340/10 X |
| 3,266,011 | 8/1966 | Massa | 340/10 X |

*Primary Examiner*—Harold J. Tudor

*Attorney, Agent, or Firm*—Harvey David; John Becker; Sol Sheinbein

[57] ABSTRACT

An electroacoustic transducer having a truncated hemispheric propagation or response pattern is disclosed. The transducer comprises an assembly of fish-bone shaped piezoelectric elements, each characterized by a plurality of rod portions extending from a spine portion. The assembly is pivotally mounted within a liquid filled acoustic window means.

6 Claims, 3 Drawing Sheets

ELECTROACOUSTIC TRANSDUCER

STATEMENT OF GOVERNMENT INTEREST

The invention described herein may be manufactured and used by or for the Government of the United States of America for governmental purposes without the payment of any royalties thereon or therefor.

FIELD OF THE INVENTION

This invention relates to electroacoustic transducers for the propagation and/or reception of acoustic energy in a subaqueous environment. More particularly, the invention is directed to an improved transducer having selected frequency bandwidth and directivity characteristics.

Electroacoustic transducers find application in various systems and devices, including sonars, mines, and ship or submarine acoustic signature simulators for training or decoy purposes. In the latter instance, the transducer may form part of a towed or a self-propelled device and be required to have a predetermined propagation and/or reception directivity pattern which will optimize the use of electrical and sound energy for the purpose at hand. Additionally, transducers for the mentioned purposes must be capable of dependable operation at substantial depths and, where the device is expendable, as in the case of some decoys, must be small enough for storage in some quantity, as well as be inexpensive to manufacture and maintain.

DISCUSSION OF THE PRIOR ART

Electroacoustic transducers are well known which achieve their desired bandwidth and directivity characteristics by providing a stack or assembly of piezoelectric discs of different diameters and spaced along a common axis. An example of such a transducer is disclosed in my patent application Ser. No. 397,366, filed Sept. 15, 1964, and assigned to the assignee hereof. The directivity pattern achieved by that transducer construction is in the form of a solid hemisphere. While such a pattern is desired for some purposes, it is desirable for other purposes to constrain the pattern to a solid section of a hemisphere; that is to say, a truncated hemisphere.

Moreover, the transducer disclosed in the mentioned application is subject to certain piezoelectric element mounting and clamping losses which reduce the efficiency thereof. Additionally, the use of pressure release zones or surfaces to prevent backward radiation in prior multiple discrete transducer arrays has been accompanied by difficulties in achieving reliable operation at the high pressures experienced at substantial ocean depths.

BRIEF SUMMARY OF THE INVENTION

The invention aims to overcome or reduce at least some of the shortcomings of the prior art transducers, and to provide a transducer which is characterized by a directivity or propagation pattern which is in the shape of a solid section of a hemisphere, through certain novel constructions, combinations of elements, and arrangements of parts. Notably, the invention includes a stack of progressively sized, piezoelectric elements, each of which has a characteristic shape reminiscent of a fish skeleton.

It is, therefore, a principal object of the invention to provide an improved electroacoustic transducer having predetermined frequency bandwidth and directivity pattern characteristics.

It is another object of the invention to provide an improved transducer which is capable of being used with reliability at substantial water depths.

Still another object is the provision of such a transducer which is easily and inexpensively constructed, is rugged, compact, and efficient in operation.

Yet another object is to provide, in a multi-element transducer, individual elements, each of which comprises a plurality of parallel, piezoelectric rod portions extending from a common spine portion, the rod and spine portions being cut or formed from a single slab or billet of piezoelectric material, and each element including surface electrode means and which are polarized to emanate or receive vibratory energy essentially endwise of the rod portions.

A further object is to provide a multi-element transducer comprising a plurality of the aforementioned individual elements of graduated sizes disposed in spaced relation to one another along an axis which is orthogonal to the rod portions and to the spine portions, whereby a frusto-hemispheric radiation or reception pattern is achieved.

As another object, a transducer embodying the invention comprises a housing including an acoustically clear window within which a stack or assembly of transducer elements is supported by horizontal pivot means to maintain a predetermined attitude, and which housing is flooded by a substantially acoustically clear liquid to permit operation under high ambient pressures.

Other objects and many of the attendant advantages will be readily appreciated as the subject invention becomes better understood by reference to the following detailed description, when considered in conjunction with the accompanying drawings.

Figure 7:
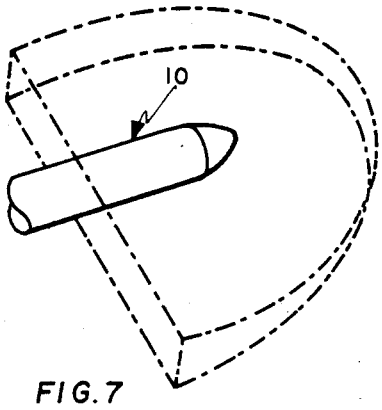
Figure 8:
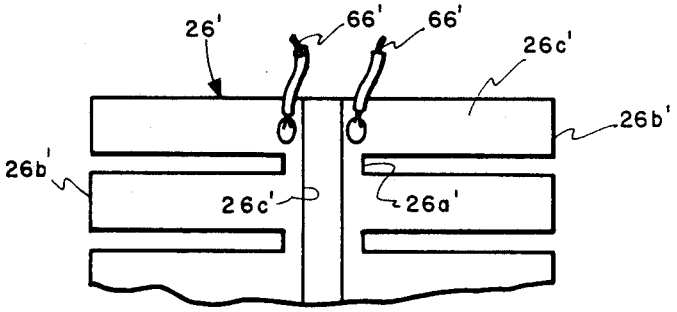

FIG: 6 is a diagrammatic illustration of electrical connections to piezoelectric elements of the transducer;

FIG. 7 is a perspective illustration of a propagation pattern;

FIG. 8 is an illustration of a modified form of piezoelectric element; and

Figure 9:
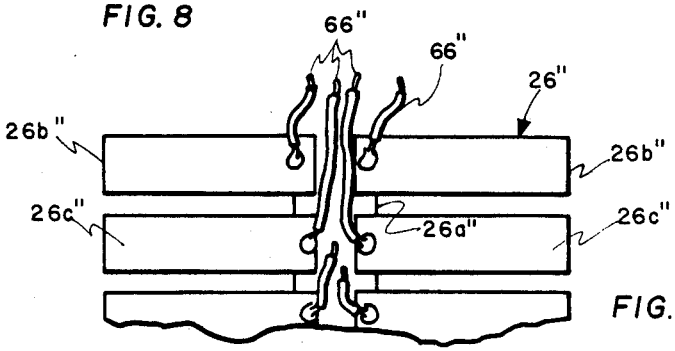

FIG. 9 is an illustration of another modified form of piezoelectric element.

DESCRIPTION OF THE PREFERRED EMBODIMENT

In the form of the invention illustrated in the drawings and described hereinafter, there is provided an electroacoustic transducer, generally indicated at 10, which is shown in association with a portion of the body 12 of an underwater device, such as a decoy, which is adapted to be deployed by a submarine to mislead antisubmarine instrumentalities. The transducer 10 comprises housing means including a thin walled shell or acoustic window 14 which, in this embodiment, is formed of aluminum or some other suitable acoustically clear material. Acoustic window 14, which encloses a piezoelectric element stack or assembly 16, is generally cylindrical and extends to one side of an end wall 12*a* of the body 12 of the associated device. Suitable fasteners 18 secure window 14 to body 12, while an O-ring 20 provides a seal between the surrounding medium and the interior of transducer 10. Acoustic window 14 may be hydrodynamically shaped at the end 14*a* thereof remote from body 12. Fixed in the end of 14*a* of acoustic window 14 is a wall or bulkhead 22 which serves, along with end wall 12*a* of body 12, to support piezoelectric stack or assembly 16.

Assembly 16 comprises a plurality of piezoelectric elements 26, mounted in spaced parallel relation to one another along a predetermined axis and between a pair of parallel, rectangular mounting panels 28 and 30 which are formed of a rigid material, such as fiberglass reinforced plastic. Panels 28 and 30 are fixed at their opposite ends between transverse, rigid end members in the form of discs 32 and 34, also made of fiberglass reinforced plastic. Disc 32 has extending from the center thereof a shaft 36 which is carried by friction reducing bearing means 38 recessed in end wall 12*a* of body 12. Similarly, disc 34 has a shaft 40 extending from the center thereof, in axial alignment with shaft 36, and is carried by friction reducing bearing means 42 recessed in bulkhead 22. A weight 46 is bonded to the underside of panel 30 and serves to maintain assembly 16 in a predetermined position about the normally horizontal predetermined axis defined through shafts 36 and 40, irrespective of rolling movements of body 12 and acoustic window 14 about that axis.

Disc 32 further has a plurality of electrical slip-rings 48*a*, 48*b*, 48*c*, and 48*d* mounted on the outer face thereof and concentric about the axis of shaft 36. Slip-rings 48*a*. .48*d* cooperate with brushes 50*a*, 50*b*, 50*c*, and 50*d*, respectively, to carry electrical signals between assembly 16 and electronics housed within body 12. The electronics housed within body 12 may comprise a signal generating transmitter, a signal receiver, or a transmitter and receiver. In the present example, the electronics will be considered to be a transmitter and receiver generally indicated at 52, and referred hereinafter as transceiver 52. Transceiver 52 is coupled to a suitable brush carrier 54 by multiconductor cable means 56.

Figure 2:
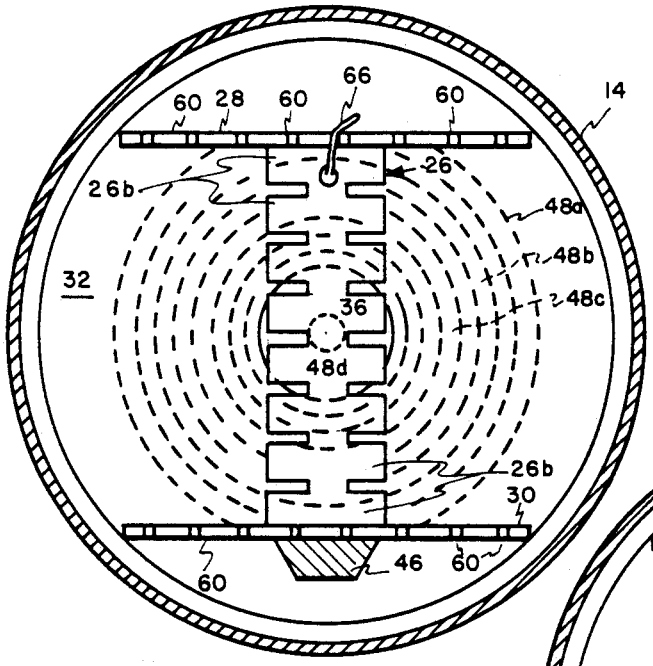
FIG. 2 is a sectional view of the transducer of FIG. 1 taken substantially along line 2—2 thereof.
Figure 3:
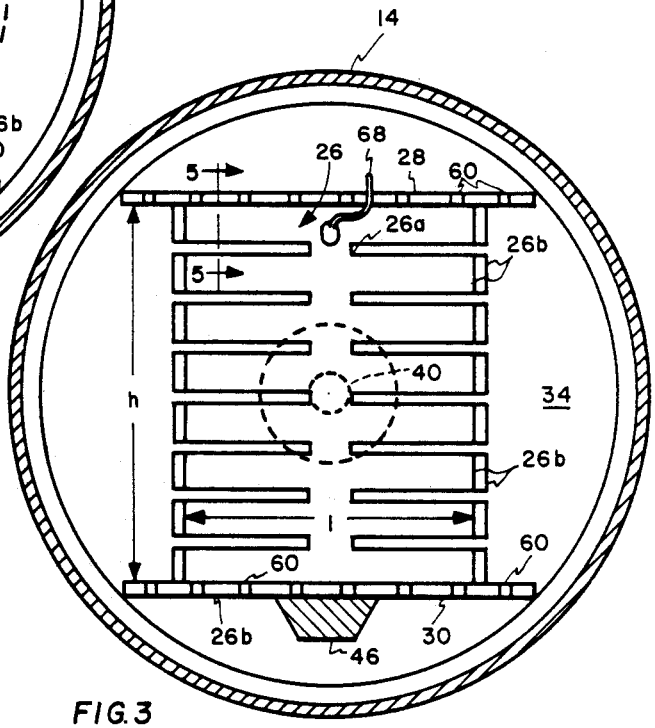
FIG. 3 is a sectional view taken substantially along line 3—3 of FIG. 1.
Figure 4:
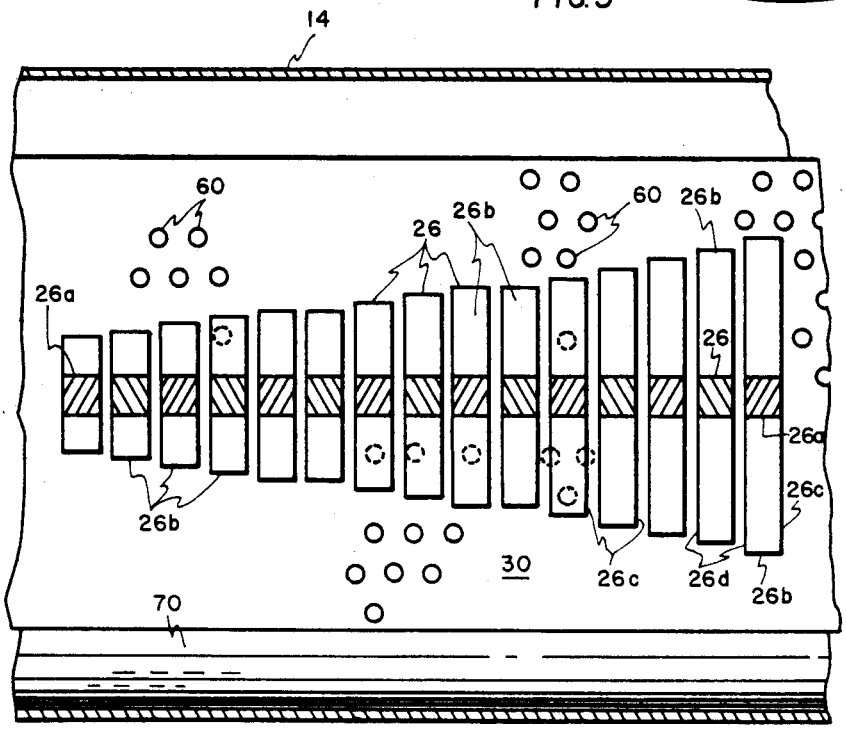
FIG. 4 is a fragmentary sectional view taken along line 4—4 of FIG. 1.

Referring more particularly now to FIGS. 2, 3, and 4, it will be observed that piezoelectric elements 26 are each if similar configuration, are conveniently identical in height and in thickness, but are, with two exceptions, of different widths. The elements are arranged so as to be greater in width going from one end of assembly 16 to the other.

Each of elements 26 includes a central spine portion 26*a* from which extend, in a somewhat rib-like manner, a plurality of parallel rod portions 26*b*. Rod portions 26*b* are equally spaced from one another along the spine portion and are disposed opposite one another on opposite sides thereof. Piezoelectric elements 26 are formed from a suitable well known ceramic crystal material such as barium-titanate or lead-zirconate-titanate, and include on the opposite plane surfaces thereof electrodes 26*c* and 26*d*, formed as a conductive coating of silver or a silver compound, preferably of the fired-on variety. Polarization of rod portions 26*b* transverse to their lengths by application of changing voltage potentials between electrodes 26*c* and 26*d*, at a suitable desired frequency, causes the rod portions to change length at that frequency and hence to radiate acoustic energy end-wise from their respective ends. Conversely, application of acoustic energy to the ends of rod portions 26*b* will cause corresponding voltage signals to appear across the electrodes thereof.

Each pair of opposed rod portions 26*b* has a characteristic resonant frequency which is a function of the total length l thereof. Since in the described embodiment the rod portions of any given piezoelectric element 26 are of equal length, each element 26 may be considered to have a characteristic resonant frequency.

Manufacture of elements 26 is easily accomplished starting with a thin rectangular blank or billet of ceramic piezoelectric material that has been plated or coated on opposite plane surfaces thereof with electrode material. Ceramic material and electrode material are then removed together by sawing a plurality of parallel slots into each edge of the blank to a predetermined depth, thereby leaving the desired central spine portion 26*a* and rod portion 26*b* extending therefrom. Polarization of each element is across the thickness thereof, so as to provide end-wise propagation of acoustic energy from the rod portions 26*b* of the element when electrical signals of suitable frequency are applied to the electrodes.

The dominant resonant frequency $f_r$ of each piezoelectric element 26 is stated by the equation $$f_r = \frac{f_c}{l}$$

where $f_c$ is the frequency constant of a long thin rod (defined as having a length l to thickness or lateral dimension of 3-to-1 or greater). In one practical embodiment of the invention using elements 26 approximately 0.25" thick and a height h of about 2.5", the widths of the sawed slots between rod portions 26*b* are approximately 0.050". The spine portion widths were chosen to be 0.2" for the piezoelectric elements in an assembly 16 wherein the rod portions have lengths l ranging from 0.75" to 2.0". The spine portion widths could be wider for rod portions longer than 2.0", but should be narrower for rod portions less than 0.75" long.

Figure 5:
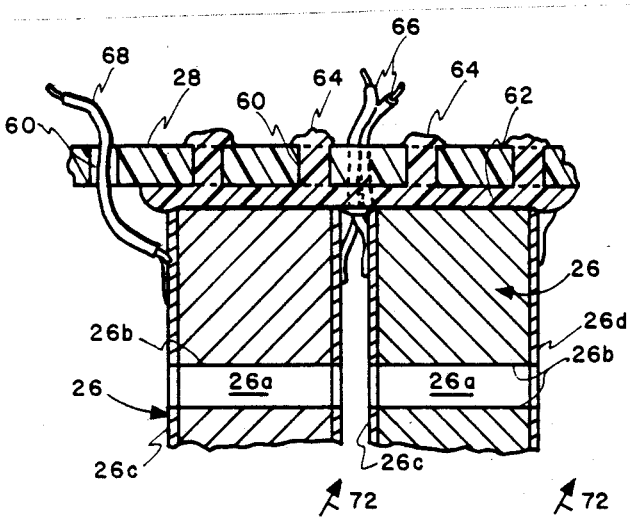
FIG. 5 is an enlarged fragmentary view of a portion of the transducer taken along line 5—5 of FIG. 3.

Piezoelectric elements 26 are held in spaced parallel relation to one another by being bonded at their upper and lower ends to panels 28 and 30, respectively. Panels 28 and 30 are preferably perforated so as to have a plurality of small openings 60 therethrough, which openings are best illustrated in FIGS. 4 and 5. Bonding of the elements 26 to the panels 28 and 30 is best accomplished by use of a resilient bonding material of the epoxy type, one suitable such material being sold under the tradename "ECCO-BOND 326". Thus, in FIG. 5, a quantity of such bonding material is shown at 62 between the upper ends of piezoelectric elements 26 and panel 28. Some of the bonding material protrudes through openings 60 and forms a head 64 which, when the bonding material hardens, provides a rivet like securement of the bonding material to panel 28.

During this bonding process piezoelectric elements 26 are conveniently maintained in equally spaced, parallel relation to one another by temporary spacers (not shown) disposed therebetween. The spacers used are sufficiently shorter than the piezoelectric elements to avoid bonding of the spacers to the material 62, thereby permitting their easy withdrawal after the material has hardened. It should be noted at this point that it is only the endmost rod portions of each element 26 that are at all restrained by bonding to panels 28 and 30. The remaining rod portions are completely free of any bonding, clamping, or other support means than the spine portion. This, together with the fact there are no pressure release surfaces or materials in the transducer, results in unusual efficiency.

Each of the electrodes 26c and 26d of the respective elements 26 is electrically connected to a lead wire for conducting electrical signals to or from the associated element. This is conveniently accomplished by soldering the end of a lead wire in a shallow groove formed in the electrode on the surface of the spine portion 26a. This is illustrated in FIGS. 2, 3, and 5 where wires 66, 68 are shown passing through convenient ones of openings 60 in panel 28 and soldered to electrodes of piezoelectric elements 26.

In the mentioned practical embodiment of the invention, which was designed to cover a frequency range of 30–90 KHz, assembly 16 comprises 14 active piezoelectric elements 26 having rod portions 26b of appropriate length l to provide multiple resonators in three frequency bands within the given range. The active ones of elements 26 are electrically connected to permit independent energization in groups corresponding to the three bands. Thus, a first band of 30 to 43 KHz corresponds to a group of six consecutive elements 26 beginning at the larger end of the series, these elements being connected in parallel for simultaneous energization. A second band of 43 to 60 KHz is served by a second group comprising the next four elements 26, namely the seventh through tenth elements, which are connected for simultaneous energization. The third band from 60 to 90 KHz is served by a third group comprising the remaining four active elements 26 which are likewise connected for simultaneous energization.

Frequency spacing of adjacent elements 26 within each group is chosen such that the resonant response curves for the adjacent elements cross over at the -6 db down points, with frequencies of the successive elements being logarithmic-periodically related. Frequency bands for best impedance matching have a Q of approximately 3.

The following table provides the frequencies and rod lengths l in inches for the piezoelectric elements used in the practical embodiment being described:

| BAND | FREQUENCY | ROD LENGTH, l |
|---|---|---|
| 30–43 KHz | 28.5 KHz | 2.2" |
| 30–43 KHz | 31.5 KHz | 2.0" |
| 30–43 KHz | 33.1 KHz | 1.9" |
| 30–43 KHz | 35.7 KHz | 1.76" |
| 30–43 KHz | 38.4 KHz | 1.64" |
| 30–43 KHz | 41.1 KHz | 1.53" |
| 43–60 KHz | 41.1 KHz | 1.53" |
| 43–60 KHz | 45.0 KHz | 1.40" |
| 43–60 KHz | 50.8 KHz | 1.24" |
| 43–60 KHz | 58.3 KHz | 1.08" |
| 60–90 KHz | 60.8 KHz | 1.08" |
| 60–90 KHz | 69.8 KHz | 0.94" |
| 60–90 KHz | 79.0 KHz | 0.83" |
| 60–90 KHz | 90.4 KHz | 0.72" |

Figure 1:
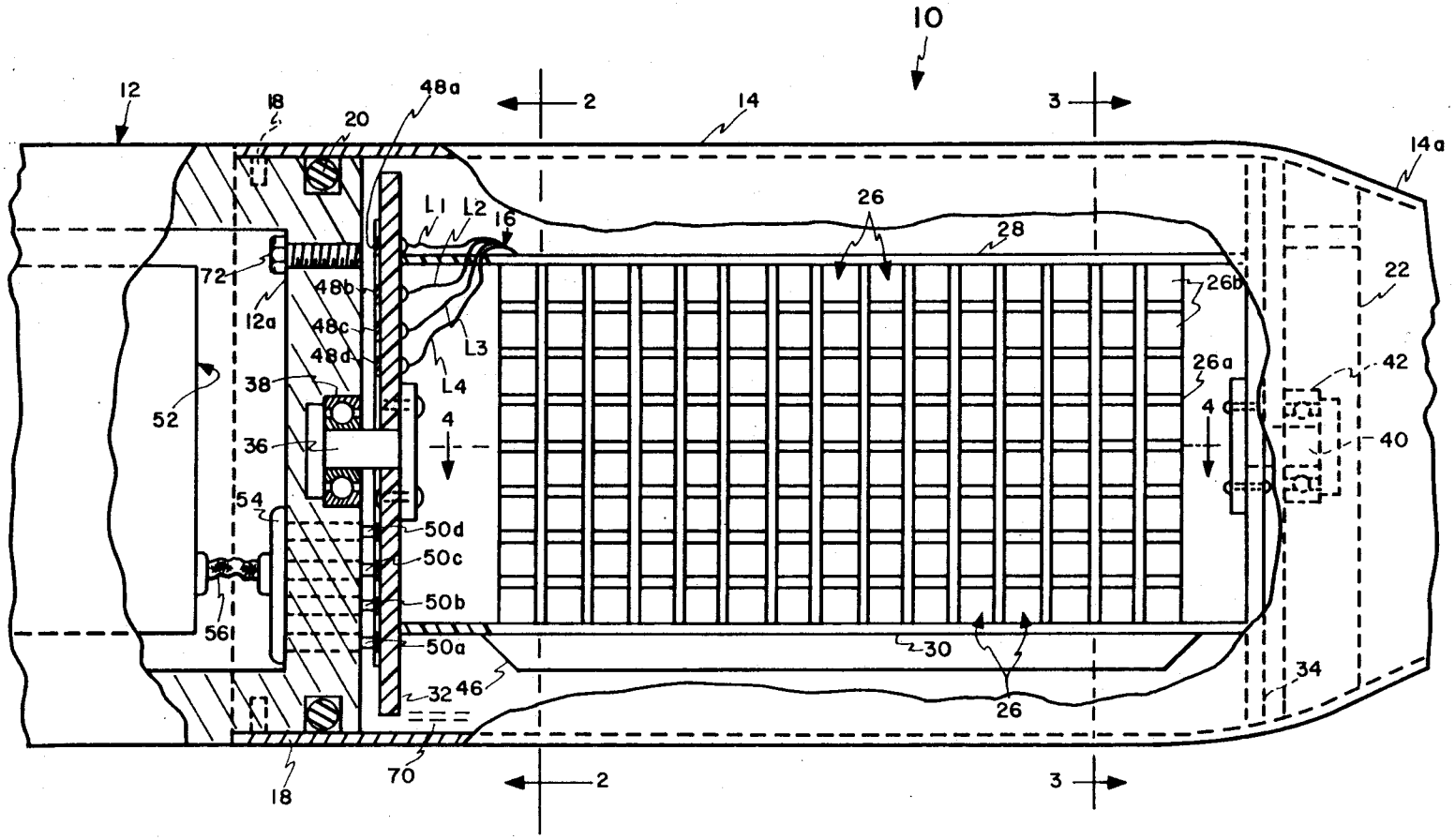
FIG. 1 is a view partly in elevation and partly in longitudinal section of a transducer embodying the invention, with portions broken away to reveal other portions.
Figure 6:
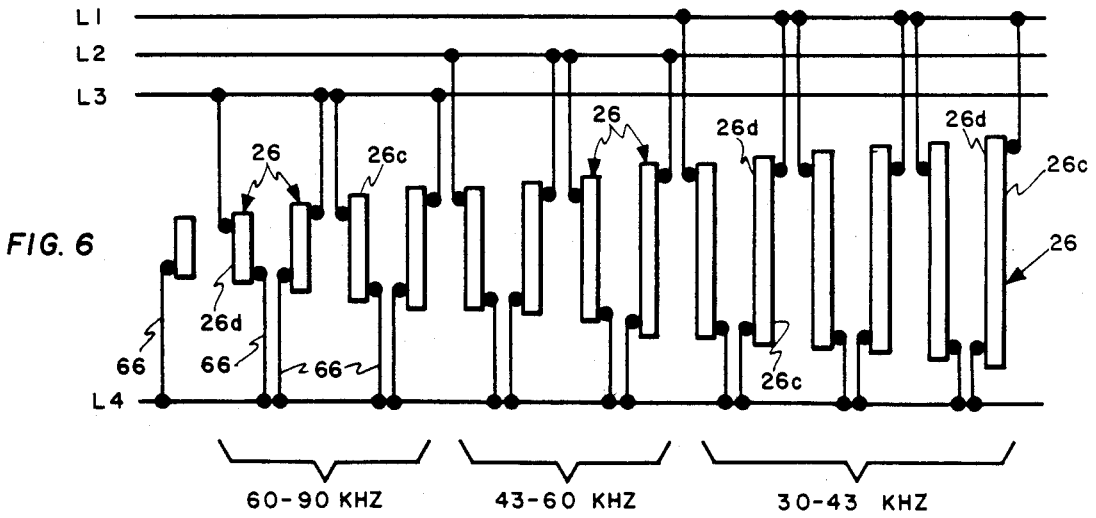

As is shown diagrammatically in FIG. 6, wherein spacings between elements 26 are exaggerated for clarity, each of the elements in the 30 to 43 KHz group has one electrode connected to a line L1, each of the elements in the 43 to 60 KHz group have one electrode each connected to a line L2, and each of the elements in the 60 to 90 KHz group have one element each connected to line L3. All of the elements 26 have their other electrodes connected to a common line L4. These lines L1, L2, L3 and L4 are shown in FIG. 1 as being connected to the respective slip-rings 48a, 48b, 48c, and 48d. Depending upon the circumstances of use, piezoelectric elements 26 may be operated one group at a time, two groups at a time, or all at the same time. It will be understood, of course, that the grouping and frequencies of the described embodiment are exemplary only and that other different groupings may be made or the piezoelectric elements may be wired for independent operation.

The transducer 10 is flooded with a suitable acoustically clear liquid 70, such as castor oil, which fills all voids, spaces, and interstices between and around the individual piezoelectric elements 26 of the assembly 16 within the acoustic window 14. A filling plug 72 is conveniently provided in an opening through end wall 12a of body 12 for use in filling the transducer. Liquid 70 serves to protect transducer 10 against deformation and damage when the transducer is used at substantial ocean depths. Moreover, the liquid aids in conduction of heat away from elements 26 and into the ambient water environment through acoustic window 14, and also serves as a damping agent to minimize oscillation of the assembly 16 about its central axis.

Because of the end-wise radiation from each of the rod portions 26b, the transducer 10 will have a principally horizontally directed radiation pattern having a vertical beam thickness approximately equal to the height h of the individual elements 26. Also, because of the different phase relationships occurring in sound energy propagated from adjacent elements 26 when driven together at a particular frequency, the direction of advance of a wave front is caused to be tilted somewhat in the direction of the larger piezoelectric elements as is shown by vectors 72 in FIG. 6. The result is a generally truncated hemispherical projection pattern. An idealized illustration of such a propagation pattern is shown in dot and dash lines in FIG. 7.

Although the larger piezoelectric elements 26 have been shown in this description as being remote from the body 12, it should be understood that the larger elements could be positioned toward the body 12 if it were desired that the propagation pattern have its directivity reversed.

Referring to FIG. 8, there is illustrated a variation of the invention wherein a piezoelectric element 26' has a spine portion 26a' and rod portions 26b' identical to those already described. The electrode, however, on at least one surface of the element, has been altered by removal of a band of electrode material down the center of the spine portion 26a' so that there remains two electrodes 26c' each serving the rod portions 26b' on its respective side of the spine portion 26a'. The construction of FIG. 8 permits selection of one or both halves of the propagation reception pattern to be used. This capability is desirable, for example, when it is necessary to distinguish from which sector acoustic signals are arriving.

In the variation illustrated in FIG. 9, a piezoelectric element 26'' has separate electrodes 26c'', each serving an individual rod portion 26b''. This construction permits individual energization of the rod portions via lines 66". Accordingly, various tilting effects of the beam in upward or downward directions can be achieved by electronically altering the phase relationships between adjacent rod portions.

Other modifications, such as using rod portions of different lengths on a given piezoelectric element, can be used to achieve certain pattern effects.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. An electroacoustic transducer comprising:

an assembly including a plurality of piezoelectric elements spaced from one another along a predetermined axis;

each of said piezoelectric elements comprising an elongated spine portion and a plurality of spaced, parallel rod portions extending orthogonally in equal numbers from opposite sides of said spine portion and lying in a common plane therewith orthogonal to said predetermined axis;

each of said piezoelectric elements further comprising electrode means, disposed on opposite sides thereof and extending parallel to said common plane, for electrical energization of all of said rod portions transverse to the lengths thereof, so as to effect expansion and contraction along said lengths thereof and normal to said spine portion;

each of said piezoelectric elements being characterized by the rod portions thereof being of a predetermined length different from the lengths of the rod portions of others of said plurality of piezoelectric elements, whereby each piezoelectric element has rod portions having a characteristic resonant frequency; and said piezoelectric elements are oriented with respect to one another in said assembly so that all of said rod portions in said assembly are parallel, and so that elements having longer rod portions are nearer one end of said assembly.

2. An electroacoustic transducer as defined in claim 1, and wherein said assembly further comprises:

first and second panel means, disposed in spaced parallel relation to one another, for supporting therebetween said plurality of piezoelectric elements; and bonding means, disposed between the ends of each of said piezoelectric elements and said first and second panel means, for said elements between said panel means with said rod portions having their respective ends facing outwardly from between said panel means.

3. An electroacoustic transducer as defined in claim 2, and further comprising:

housing means, including substantially acoustically clear window means, for excluding an ambient medium form said piezoelectric element assembly;

a body of substantially acoustically clear liquid filling said housing and flooding all spaces, voids, and interstices of said assembly;

pivot means, disposed between said piezoelectric element assembly and said housing, for supporting said assembly within said housing with freedom of relative movement therebetween about said predetermined axis; and weight means, connected to said piezoelectric element assembly to one side of said axis, for causing said assembly to maintain a predetermined position about said predetermined axis irrespective of rolling movements of said housing about said predetermined axis.

4. An electroacoustic transducer as defined in claim 3, and further characterized by:

said panel means each comprising a rigid, foraminous panel disposed on opposite sides of said predetermined axis; and said bonding means comprising an adhesive material extending through foramins of said panels to effect a positive connection therewith.

5. An electroacoustic transducer as defined in claim 4, and further characterized by:

a plurality of transverse members connected between said panels at opposite ends thereof; and said pivot means comprising cooperable shafts and bearings mounted on said transverse members and said housing, respectively.

6. An electroacoustic transducer for converting electrical signals of a predetermined range of frequencies into acoustic energy in a surrounding fluid medium and vice versa, characterized by a truncated hemispheric directivity pattern of propagation and response, said transducer comprising:

a liquid tight housing including a cylindrical acoustic window;

a piezoelectric stack assembly mounted within said housing for pivotal relative movements between said housing and said assembly about a common central axis, said assembly comprising first and second rigid panels disposed parallel to said axis on opposite sides thereof and parallel to one another, and a plurality of generally rectangular, flat piezoelectric elements of equal heights and different widths mounted between said panels in spaced parallel relation to one another and arranged progressively with the wider piezoelectric elements nearer one end of said assembly;

said piezoelectric elements each characterized as having an elongated central spine portion from which extend, in equal numbers of three or more on opposite sides, a plurality of parallel rod portions which are equally spaced from one another, said rod portions being integral with said spine portion and lying in a common plane therewith;

each of said piezoelectric elements further including electrodes on opposite plane surfaces of all of said rod portions for energization by changing voltage potentials of predetermined frequencies so as to effect vibrations of said rod portions lengthwise thereof normal to said spine portion, each of said piezoelectric elements having its rod portions all of equal length but differing form the lengths of rod portions of others of said plurality of piezoelectric elements;

slip ring and brush means, mounted on said housing and said assembly, for effecting electrical connection to said piezoelectric elements irrespective of said relative movements; and a substantially acoustically clear, electrically insulative liquid filling said housing and flooding all spaces, voids, and interstices of said assembly.

* * * * *